United States Patent [19]

Watanabe et al.

[11] Patent Number: 4,979,593

[45] Date of Patent: Dec. 25, 1990

[54] ELEVATOR CONTROLLER

[75] Inventors: Eiki Watanabe; Masahiro Noda, both of Aichi, Japan

[73] Assignee: Mitsubishi Denki Kabushiki Kaisha, Japan

[21] Appl. No.: 233,047

[22] Filed: Aug. 17, 1988

[30] Foreign Application Priority Data

Aug. 26, 1987 [JP] Japan ..... 62-211932

[51] Int. Cl.[5] ..... B66B 9/06

[52] U.S. Cl. ..... 187/12; 187/130; 187/139; 104/112; 104/295

[58] Field of Search ..... 187/12, 28, 17, 134, 187/136, 135, 130, 139; 104/112, 127, 128, 295; 191/3, 40, 41; 455/52, 127; 340/825.72

[56] References Cited

U.S. PATENT DOCUMENTS

| | | | |
|---|---|---|---|
| 2,505,144 | 4/1950 | Rutherford | 187/130 |
| 2,602,524 | 7/1952 | Shirley | 187/139 |
| 3,203,506 | 8/1965 | Cummins | 187/130 |
| 3,686,447 | 8/1972 | Takalo | 104/295 |
| 4,163,480 | 8/1979 | Highland | 104/112 |
| 4,471,356 | 9/1984 | Gidl | 187/136 |
| 4,567,334 | 1/1986 | Wilcox | 104/112 |
| 4,623,869 | 11/1986 | Marubashi | 187/130 |
| 4,768,740 | 9/1988 | Corrie | 104/295 |

FOREIGN PATENT DOCUMENTS

| | | | |
|---|---|---|---|
| 5117788 | 12/1970 | Japan . | |
| 58127066 | 2/1982 | Japan . | |
| 11166 | of 1913 | United Kingdom | 187/130 |

OTHER PUBLICATIONS

Spahn, "Die Elektrische Ausrustung der Schnellaufzuge im Fernsehturm Moskau", AEG-Mitteilungen 57 (1967) 5.

*Primary Examiner*—H. Grant Skaggs
*Assistant Examiner*—Kenneth Noland
*Attorney, Agent, or Firm*—Leydig, Voit & Mayer

[57] ABSTRACT

In an elevator system comprising a machine room and an elevator car, as the elevator car moves along a hoistway between a plurality of floors, a radio system permits wireless communication between the machine room and the elevator car. As the elevator car moves along the hoistway, the distance between the elevator car and the machine room varies. To effect stable signal transmission and avoid receiver saturation when the elevator car is in close proximity to the machine room, the output of the transmitter or the sensitivity of the receiver is varied in accordance with the distance between the elevator car and the machine room.

17 Claims, 5 Drawing Sheets

ELEVATOR CONTROLLER

TECHNICAL FIELD

The present invention relates to an elevator controller, and, more particularly, to an elevator controller having an improver system for transmission of electric communication signals between an elevator car and a machine room.

BACKGROUND ART

In elevator systems, it has heretofore been general practice to provide a traveling cable between an elevator car and a machine room in order to effect signal transmission between the car and the machine room and also to supply electric power from the machine room to the car. However, it may not be possible to use such a traveling cable in outdoor observation elevators or high rise reclined elevators. For this reason, systems in which no traveling cable is employed to effect signal transmission and supply power between the car and the machine room have been proposed and put into practical use. These prior art systems include a first type in which an elevator car with a battery thereon uses power supplied from the battery for illumination inside the car and for activation of a drive unit for opening and closing the door of the car. An inductive radio is employed to effect signal transmission between the elevator car and the machine room. A second type of conventional system employs trolley wires disposed along the hoistway to supply power and signal transmission between the car and the machine room.

These prior art systems suffer, however, from the following disadvantages.

In the first type of conventional system, the battery that is loaded on the elevator car has the disadvantages of heavy weight, troublesome maintenance, short lifetime, and high cost. In addition, the inductive radio that is employed to effect signal transmission between the car and the machine room is practical only when used for transmission of an operating condition signal, such as a signal for calling the car. It is predicted that the error rate of a serial transmitter is in the range of about $1\times10^{-4}$ to $1\times10^{-9}$. Accordingly, the inductive radio is not sufficiently reliable for transmission of safety circuit signals, such as an emergency stop signal generated when an emergency situation occurs or a detection signal representing that the car door is open.

Further, since the frequency band for the inductive radio is restricted to several hundred kHz, it is impossible to transmit a video signal (5 to 6 MHz bandwidth) from a camera provided to monitor the inside of the elevator car.

In the abovementioned second system, since transmission of all signals is effected through trolley wires, it is necessary to provide a number of trolley wires commensurate with the number of floors at which the car needs to stop. Because signal lines for a call button, an answering lamp, and a floor display lamp must be provided for each of the floors, an increase in the number of floors requires a correspondingly increased number of signal lines. Accordingly, this type of conventional system is practical only where the car must stop at a small number of floors, since the number of trolley wires then will be correspondingly small. With a large number of floors, it may be physically impossible to lay out the correspondingly large number of trolley wires along the hoistway.

DISCLOSURE OF THE INVENTION

In view of the above-described prior art problems, it is an object of the present invention to provide an elevator controller which achieves enhanced reliability of signal transmission between the car and the machine room, permits greater diversity of signals transmitted, and reduces the number of trolley wires which need to be laid out along the hoistway, compared with conventional controllers.

To this end, the present invention provides an elevator employing trolley wires to supply power from a machine room of an elevator to an elevator car and to transmit a safety circuit signal from the car to the machine room. A radio system is used to transmit operating condition signals between the car and the machine room by varying the output of the radio system in accordance with the distance between the car and the machine room as the elevator car travels through the hoistway.

According to the present invention, trolley wires are employed only to supply power and to transmit a safety circuit signal between the car and the machine room. Therefore, the number of trolley wires required is small and does not vary with the number of floors where the car needs to stop. In addition, since the transfer of operating condition signals between the car and the machine room is effected through a radio system, and the output of the radio system is varied in accordance with the distance between the car and the machine room, it is possible to transfer a variety of information stably and reliably.

BEST MODE FOR CARRYING OUT THE INVENTION

Figure 1:
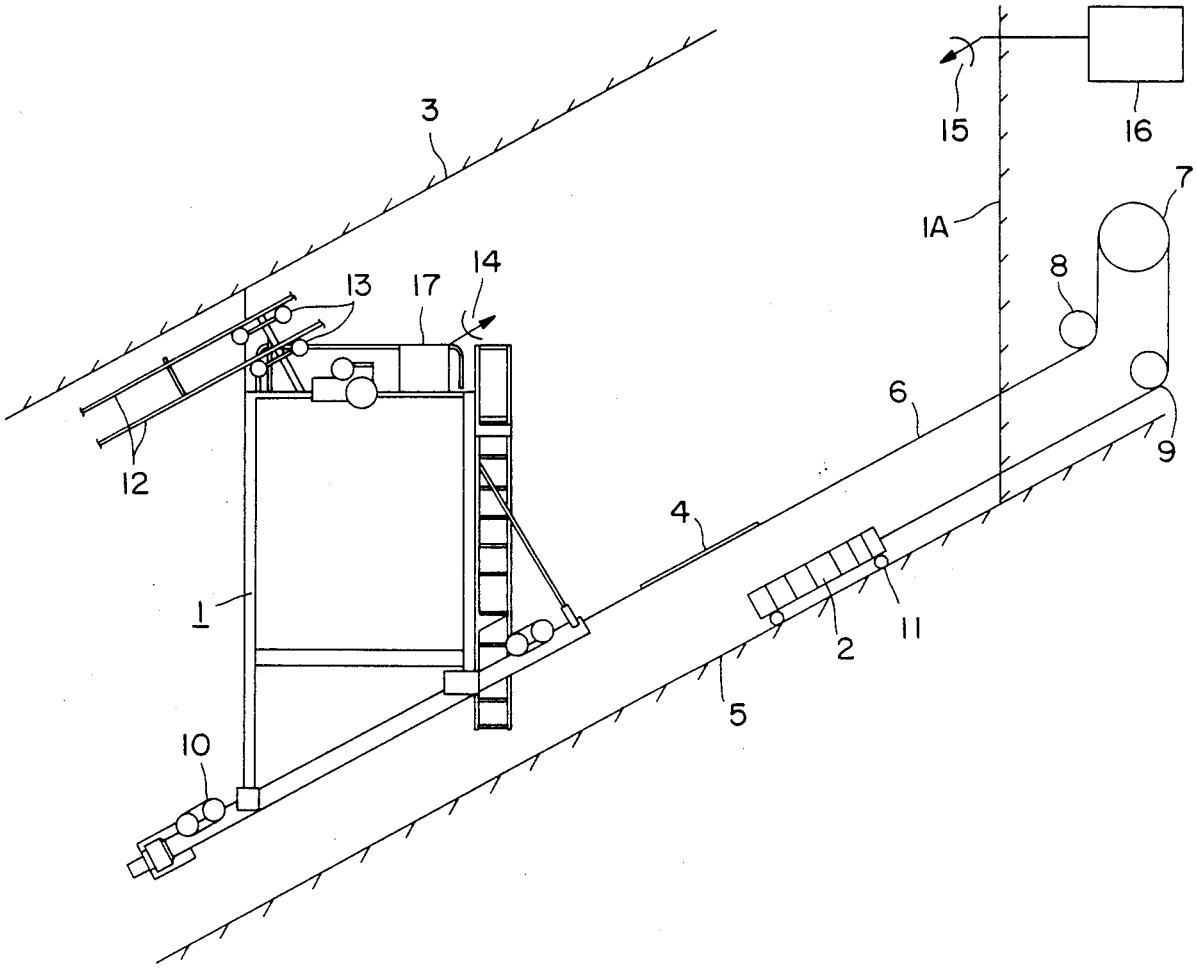
FIG. 1 schematically shows an embodiment in which the elevator controller of the present invention is applied to an inclined elevator.

FIG. 1 schematically shows an embodiment of the present invention applied to an inclined elevator. An elevator car 1 is balanced by a counterweight 2 in a hoistway 3. The elevator car 1 is disposed on a rail 4 running the length of the hoistway 3, and the counterweight 2 is disposed on a rail 5 also running the length of the hoistway 3. A rope 6 connects the elevator car 1 and the counterweight 2. To cause the elevator car 1 and the counterweight 2 to move in contrary directions in the hoistway 3, the rope 6 engages a pulley system comprising a sheave 7 and deflector sheaves 8, 9. To guide motion of the elevator car 1 along the hoistway 3, car-side guide rollers 10 are disposed on the elevator car 1 to engage the rail 4. Likewise, to guide motion of the counterweight 2 along the hoistway 3, counterweight car-side guide rollers 11 are disposed on the counterweight 2 to engage the rail 5.

A machine room 1A, herein shown at the top of the hoistway 3, controls the operation of the elevator car 1. In order to permit communication between the elevator car 1 and the machine room 1A, trolley wires 12 are disposed along the hoistway 3 and connected to the machine 1A. To provide electrical connections between the trolley wires 12 and the elevator car 1, collectors 13 are mounted on the elevator car 1 to engage the trolley wires 12 and maintain engagement therewith as the elevator car 1 moves along the hoistway 3. To further permit communication between the elevator car 1 and the machine room 1A, a radio system with components installed in the elevator car 1 and the machine room 1A is provided. In the illustrated embodiment, an antenna 14 is mounted on the elevator car 1. Likewise, an antenna 15 is mounted in the vicinity of the the machine room 1A to permit communication of radio frequency signals between the antennae 14, 15. To permit operators to monitor and control the elevator car 1, a machine room control board 16 and a car control board 17 are provided in the machine room 1A and in the elevator car 1, respectively.

Figure 2:
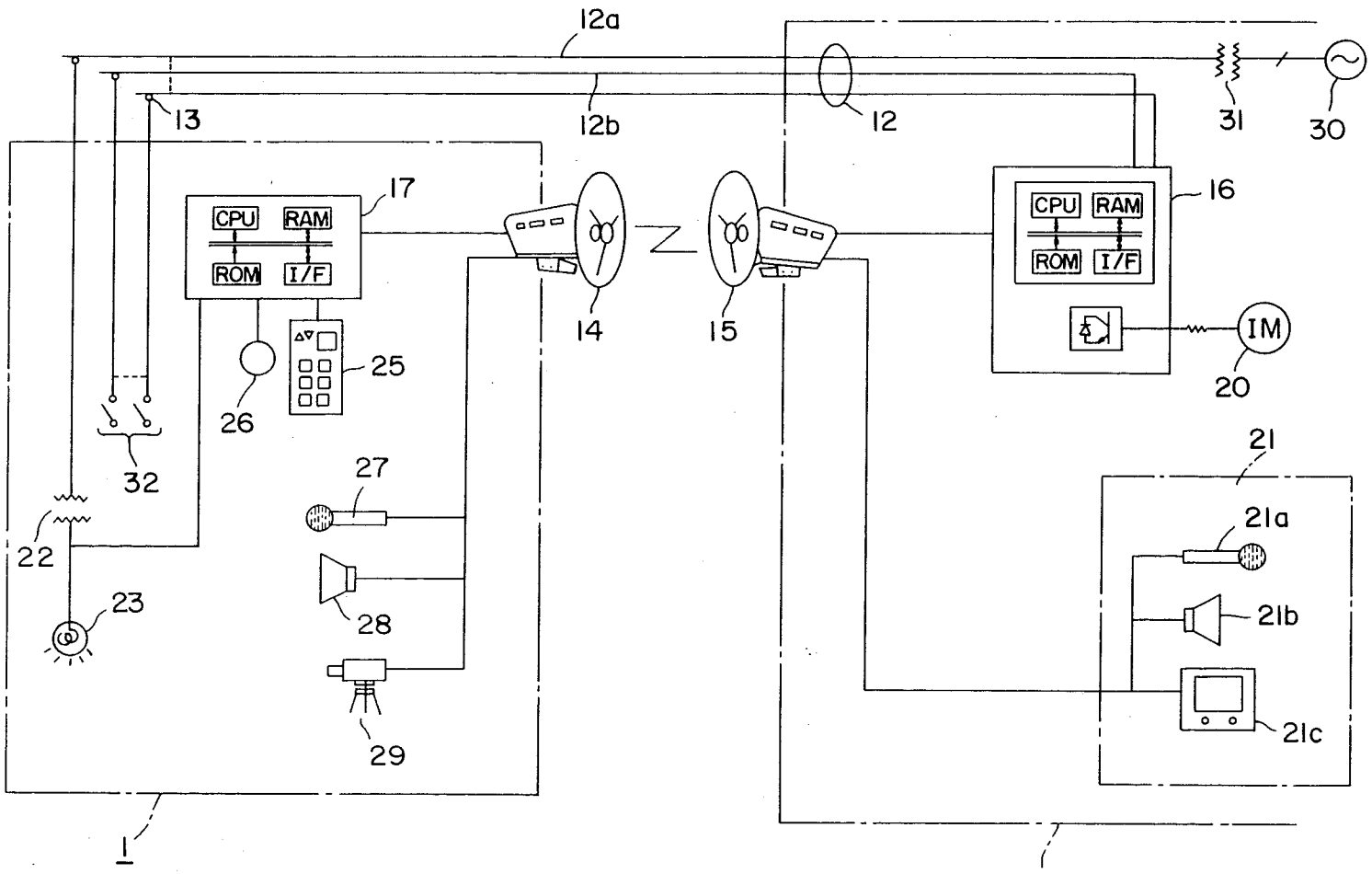
FIG. 2 shows an arrangement of a radio system for communication between an elevator car and an elevator machine room.

FIG. 2 shows the arrangement of the radio system between the car 1 and the machine house 1A. A power trolley wire 12*a* supplies electric power from the machine room 1A to the elevator car 1. In the machine room 1A, electric power is delivered from a power supply 30 to the power trolley wire 12*a* through a transformer 31. A safety circuit trolley wire 12*b* transmits a safety circuit signal output from a safety circuit switch 32 in the elevator car 1 to the control board 16 in the machine room 1A. A car control board 17 provided in the elevator car 1 comprises a microprocessor which is programmed to output a door open/close command to an electric motor 26 to open and close the elevator car door on the basis of a call registration signal input from an elevator car operating panel 25, and also to generate a door closing completion signal which is transmitted to the machine room 1A. A microphone 27 receives voice messages from the elevator car 1 for transmission to the machine room 1A. A loudspeaker 28 delivers a voice message transmitted from the machine room 1A to the inside of the elevator car 1. A television camera 29 obtains pictorial information from inside the elevator car 1 for transmission to the machine room 1A. These operating condition signals, i.e., the door closing completion signal, voice message, and pictorial information, are transmitted from the elevator car antenna 14 to the machine room 1A. The elevator car antenna 14 also receives signals transmitted from the machine room 1A. A transformer 22 lowers the voltage of the electric power supplied from the power trolley wire 12*a* and supplies the power to the car control board 17 and an illumination lamp 23 provided in the elevator car 1.

The antenna 15 transmits car position signal, voice, and pictorial information from the machine room 1A to the elevator car 1. A machine room control board 16 comprises a microprocessor which is supplied with a stopping position signal received by the machine room antenna 15 to control the drive of a hoisting electric motor 20. A monitor board 21 for monitoring the elevator car 1 has a microphone 21*a*, and a loudspeaker 21*b* for voice communication between the machine room 1A and the elevator car 1, and a monitor 21*c* for displaying the interior of the elevator car 1.

Figure 3:
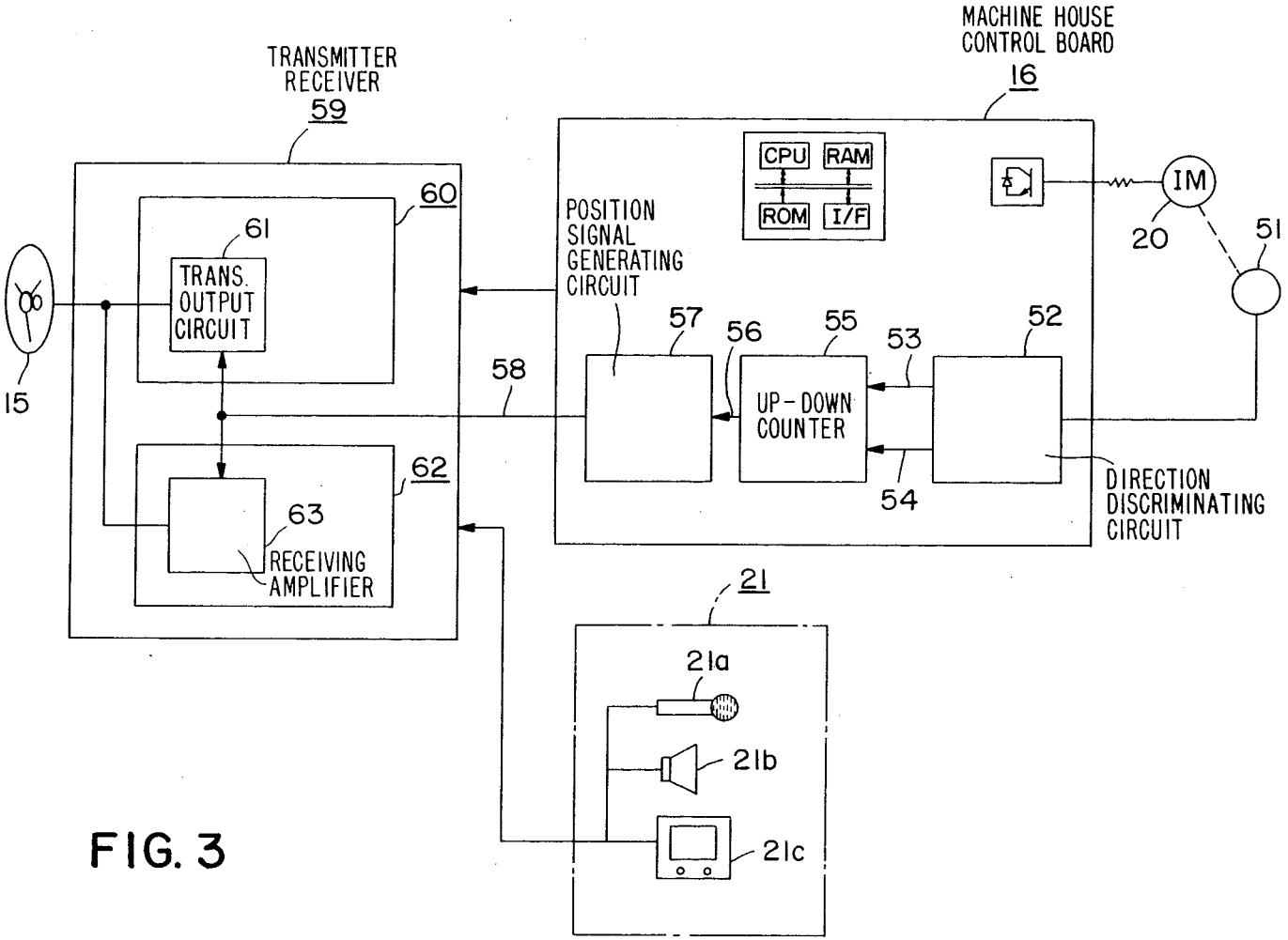
FIG. 3 is a block diagram showing one example of an arrangement for varying the output of the radio system.

FIG. 3 is a block diagram showing an example of an arrangement provided at the machine room 1A for varying the output of the radio signal transmitted by the radio system in accordance with the distance between the elevator car 1 and the machine room 1A. To produce a signal representing activity of the hoisting electric motor 20, an encoder 51 is mounted thereon with appropriate electrical connections. A direction discriminating circuit 52 which produces separate signals 53, 54 indicating upward and downward movement, respectively, is connected to receive the output signal of the encoder 51. In the present embodiment, the signals 53, 54 take the form of "up" and "down" pulses, respectively. To keep count of the number of "up" and "down" pulses 53, 54 and thereby provide a quantitative indication of the position of the elevator car 1 in the hoistway 3, an up-down counter 55 is connected to receive the pulses 53, 54 and to produce an output signal 56. A position signal generating circuit 57 is connected to receive the signal 56 and produce a car position signal 58.

To provide radio communication with the elevator car 1, the radio system arrangement provided at the machine room 1A further comprises a transmitter-receiver 59. To transmit radio signals from the antenna 15, the transmitter-receiver 59 comprises a transmitting circuit 60 with a transmitting output circuit 61. The output circuit 61 is connected to receive the car position signal 58, and the output of the output circuit 61 is controlled in accordance therewith. To receive radio signals transmitted from the antenna 14, the transmitter-receiver 59 further comprises a receiving circuit 62 with a receiving amplifier 63. The receiving amplifier 63 is connected to receive the car position signal 58, and the sensitivity of the receiving amplifier 63 is controlled in accordance therewith.

Electric power is supplied to the illumination lamp 23 and the car control board 17 inside the elevator car 1 from the machine room 1A through the power supply trolley wire 12*a* laid out through the hoistway 3. A detection signal output from a door closing detecting switch for detecting the fact that the door of the elevator car 1 is closed is delivered as a safety related condition signal to the control board 16 in the machine room 1A through the safety circuit switch 32 and a safety circuit trolley wire 12*b* which is also laid out through the hoistway.

When the destination of the elevator car 1 is registered through the operating panel 25 in the elevator car 1, the microprocessor of the car control board 17 issues a door closing command to the door opening/closing motor 26 to close the door. When the door has been closed, the safety circuit switch 32 delivers a door closing completion signal to the machine room control board 16 through the safety circuit trolley wire 12*b*. The microprocessor of the car control board 17 delivers a destination floor signal to the car antenna 14. The destination floor signal is transmitted to the machine room antenna 15 on a radio signal, herein embodied as a 50 GHz signal. An audio signal from the microphone 27 and a video signal from the television camera 29 are also transmitted on the radio signal. In the machine room 1A, the radio signal is received by the antenna 15, The destination floor signal is delivered to the control board 16, and the audio and video signals are delivered to the monitor board 21 to activate the loudspeaker 21*b* and the monitor 21*c*. An audio signal from the microphone 21*a* and a car position signal from the control board 16 are transmitted on a radio signal from the machine house antenna 15 to the car antenna 14. When the signals are received at the elevator car 1, indicator lights on the operating panel 25 are turned on by the operation of the microprocessor of the car control board 17.

The elevator car 1 is brought to a halt when an emergency stop button on the operating panel 25 is pressed or when a safety device at the elevator is activated. In such a case, the safety circuit switch 32 is actuated to deliver a safety circuit signal to the machine room control board 16 through the safety circuit trolley wire **12*b* to bring the motor 20** to a sudden stop.

The operation of varying the output of the radio signal transmitted by the radio system in accordance with the distance between the elevator car 1 and the machine room 1A will next be described with reference to FIG. 3. The output of the encoder 51 changes in accordance with the rotation of the motor 20 which moves the elevator car 1. The direction discriminating circuit 52 outputs signals corresponding to the direction and speed of movement of the elevator car 1 in the form of "up" pulses 53 or "down" pulses 54. By counting the "up" pulses 53 or "down" pulses 54 in the up-down counter 55, a count corresponding to the position of the elevator car 1 is obtained. The output signal 56 of the counter 55, which reflects the above-mentioned count, is input to the position signal generating circuit 57, which generates a car position signal 58 on the basis of the signal 56. In accordance with the car position signal 58, the output of the transmitting output circuit 61 is controlled in such a manner that, when the car 1 moves toward the machine room 1A, the output of the circuit 61 is reduced. Likewise, when the elevator car 1 moves away from the machine room 1A, the output of the circuit 61 is increased. Similarly, the gain of the receiving amplifier 63 is controlled in accordance with the car position signal 58 such that, when the elevator car 1 moves toward the machine room 1A, the gain is reduced. Likewise, when the elevator car 1 moves away from the machine room 1A, the gain is increased.

It should be noted that, if the output of a radio system employed to effect transmission of information between the elevation car 1 and the machine room 1A is not varied but, rather, maintained at a constant level, and if the output of the radio signal is at a strength appropriate for a maximum distance between the elevator car 1 and the machine room 1A, then when the elevator car 1 is at a minimum distance from the machine room 1A, the level of the received radio signal is excessively high, thereby saturating the receiving circuit. The result is lowered signal transmission reliability. However, in an elevator such as that of the preferred embodiment disclosed herein in which the transmission strength of the radio signal is changed in accordance with the distance between the elevator car 1 and the machine room 1A, the above-described problem is overcome, and an improvement in the signal transmission reliability is achieved.

Figure 4:
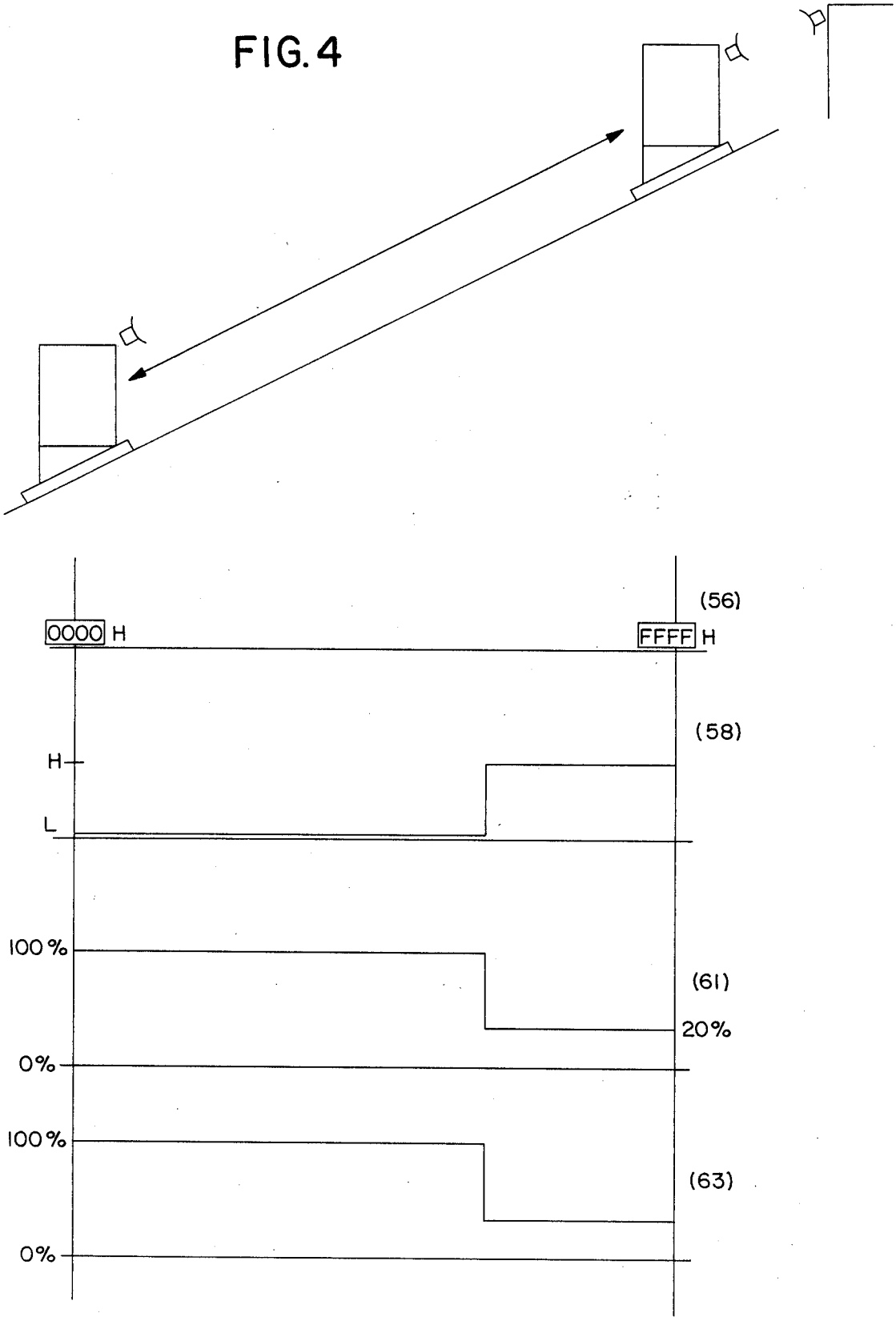
FIG. 4 shows various waveforms produced by a first alternative embodiment in which a comparator is used to constitute a car position generating circuit.
Figure 5:
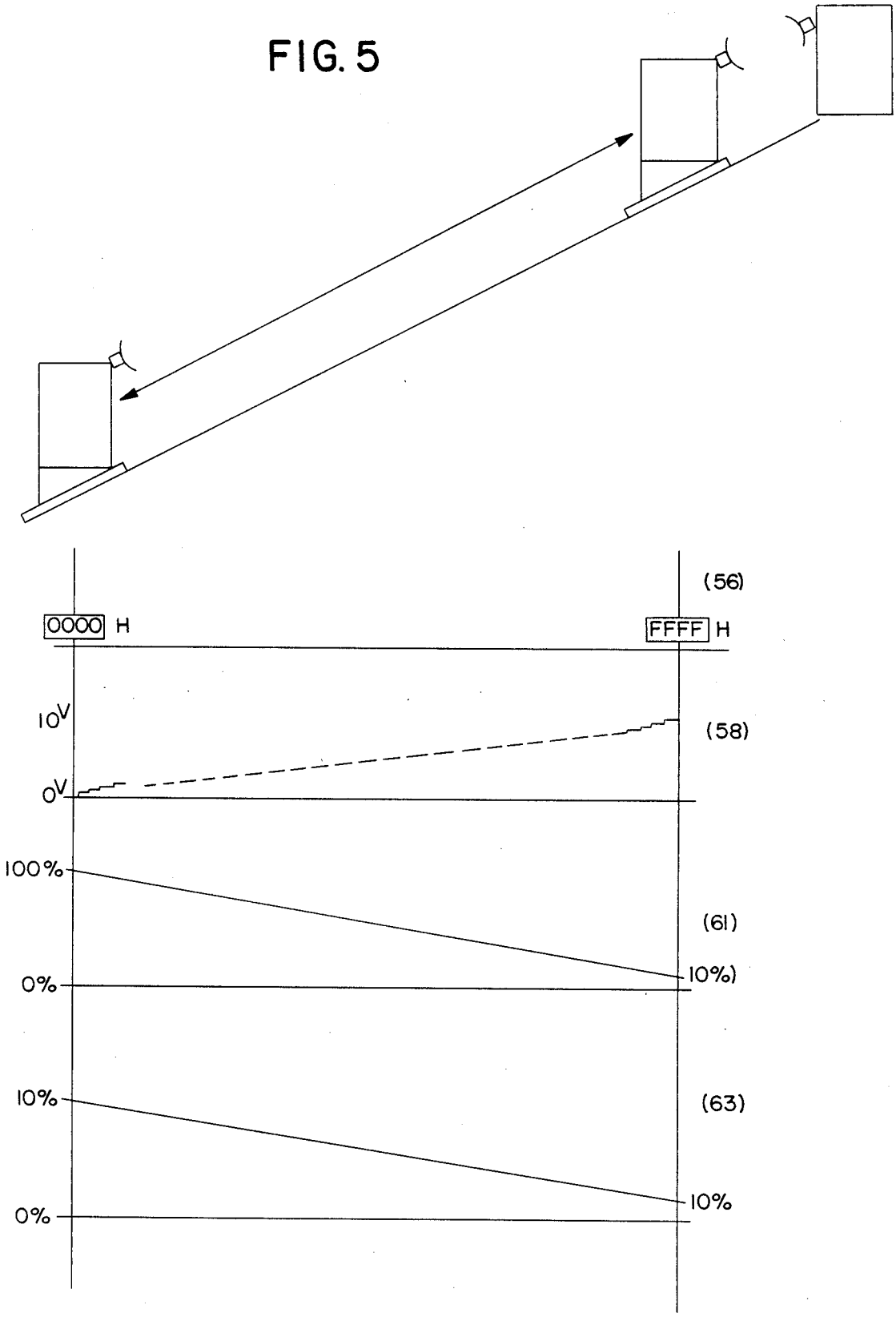
FIG. 5 shows various waveforms produced by a second alternative embodiment in which a digital-to-analog (D/A) converter is used to constitute the car position signal generating circuit.

If, in a first alternative embodiment, a comparator is used to constitute the car position generating circuit 57 in the arrangement shown in FIG. 3, the output of the transmitting output circuit 61 and the gain of the receiving amplifier 63 are controlled in such a manner as to be changed over between two voltage levels, i.e., high and low, as shown in FIG. 4. If, in a second alternative embodiment, a D/A converter is used to constitute the car position generating circuit 57 and the output 56 of the up-down counter 55 is converted into an analog car position signal 58, the output of the transmitting output circuit 61 and the gain of the receiving amplifier 63 can be linearly controlled, and it is, therefore, possible to effect delicate voltage adjustment, as shown in FIG. 5.

It should be noted that similar advantageous effects can be obtained even if the combination of the transmitting output circuit 61 and the receiving amplifier 63 in the arrangement shown in FIG. 3 is replaced with a combination of a fixed output circuit, a fixed receiving amplifier, and an attenuator, the attenuation factor of which is variable in accordance with the car position signal 58.

As has been described above, in the elevator controller according to the present invention, trolley wires are employed to supply power from the elevator machine room to the elevator car and to transmit a safety circuit signal from the elevator car to the machine room. An operating condition signal is transmitted between the elevator car and the machine room by means of a radio system. In addition, there is provided a means for varying the output of the radio system in accordance with the distance between the elevator car and the machine room as the elevator car travels along the hoistway. Accordingly, only the supply of power and the safety circuit signal require trolley wires disposed along the hoistway. Therefore, it is possible to reduce the number of trolley wires required compared to the conventional elevator controller. Further, since an operating condition signal is delivered by means of a radio signal transmitted and received by the radio system, it is possible to improve reliability of signal transmission. In addition, the increased bandwidth of the radio signal makes possible transmission of a video signal and the like, diversifying the content of the signal transmission. Since the output of the radio system is varied in accordance with the distance between the elevator car and the machine room, it is possible to considerably improve signal transmission reliability.

We claim:

1. An elevator controller comprising:

trolley wire disposed along a hoistway of an elevator to supply electric power from a machine room of the elevator to an elevator car and to transmit a safety related condition signal from the elevator car to the machine room;

a radio system which transmits information signals including an operating condition signal between the machine room and the elevator car;

a transmitter-receiver of said radio system in the machine room; said transmitter-receiver having a receiving amplifier and a transmitting output circuit;

an electric motor for moving the elevator car; and means for generating a car position signal in accordance with rotation of the electric motor, the car position signal representing distance between the elevator car and the machine room as the elevator car travels along the hoistway; and means for adjusting gain of said receiving amplifier and means for adjusting output of said transmitting output circuit in response to the car position signal whereby the radio system information signals are varied in accordance with the distance between the elevator and the machine room to avoid saturating receiving circuits.

2. An elevator controller as set forth in claim 1 wherein a first trolley wire is connected to supply the electric power from the machine room to a control board and an illumination lamp inside the elevator car.

3. An elevator controller as set forth in claim 1 wherein a second trolley wire is connected to carry said safety related condition signal including a detection signal indicating that a door of the elevator car is closed.

4. An elevator controller as set forth in claim 1 wherein the operating condition signal transmitted by said radio system includes a signal representing a destination floor of the elevator car and a display command signal for an operation panel provided in the elevator car.

5. An elevator controller as set forth in claim 4 wherein said radio system includes means for transmitting a video signal output from a television camera.

6. An elevator controller as set forth in claim 5 wherein said radio system is designed for the 50 GHz band.

7. An elevator controller comprising:

trolley wire disposed along a hoistway of an elevator to supply electric power from a machine room of the elevator to an elevator car and to transmit a safety related condition signal from the elevator car to the machine room;

a radio system which transmits a variable strength operating condition signal between the elevator car and the machine room; and output varying means for varying the strength of the transmitted operating condition signal in accordance with changes in the distance between the elevator car and the machine room as the elevator car travels along the hoistway, including means for controlling the output of a transmitter output circuit, the output circuit being provided in a transmitter-receiver of said radio system in the machine room;

an electric motor for driving the elevator; and means for generating a car position signal in accordance with rotation of the electric motor;

wherein said output varying means varies the output of said radio system in response to the car position signal.

8. An elevator controller as set forth in claim 7 wherein the car position signal comprises "up" or "down" pulses output in accordance with the direction of rotation of said electric motor, said elevator controller further comprising a counter connected to receive and count the pulses.

9. An elevator controller comprising:

trolley wires disposed along a hoistway of an elevator to supply electric power from a machine room of the elevator to an elevator car and to transmit a safety related condition signal from the elevator car to the machine room;

a radio system which transmits a variable strength operating condition signal between the elevator car and the machine room; and output varying means for varying the strength of the transmitted operating condition signal in accordance with changes in the distance between the elevator car and the machine room as the elevator car travels along the hoistway, including means for controlling the output of a transmitter output circuit, the output circuit being provided in a transmitter-receiver of said radio system in the machine room;

an electric motor for driving the elevator; and means for generating a car position signal comprising "up" or "down" pulses output in accordance with the direction of rotation of said electric motor, said elevator controller further comprising a counter connected to receive and count the pulses;

wherein said output varying means varies the output of said radio system in response to the car position signal.

10. An elevator controller as set forth in claim 9 wherein the car position signal comprises "up" or "down" pulses output in accordance with the direction of rotation of said electric motor, said elevator controller further comprising a counter connected to receive and count the pulses.

11. An elevator controller as set forth in claim 9 wherein the elevator is an outdoor observation elevator.

12. An elevator controller as set forth in claim 11 wherein the elevator is a high-lift inclined elevator.

13. An elevator controller comprising:

trolley wires disposed along a hoistway of an elevator to supply electric power from a machine room of the elevator to an elevator car and to transmit a safety related condition signal from the elevator car to the machine room;

a radio system which transmits information signals including an operating condition signal between the machine room and the elevator car;

a transmitter-receiver of said radio system in the machine room;

an electric motor for moving the elevator car;

circuits producing an output signal corresponding to direction and speed of movement of the elevator car by the electric motor;

a car position signal generating circuit receiving the output signal and providing a car position signal based thereon representing distance between the elevator car and the machine room as the elevator car travels along the hoistway; and controllable circuits associated with said transmitter-receiver and controlled in response to the car position signal whereby the radio system information signals are varied in accordance with the distance of the elevator car from the machine room to avoid saturating receiving circuits of said radio system.

14. An elevator controller according to claim 13 wherein said controllable circuits include a receiving amplifier and a transmitting output circuit.

15. An elevator controller according to claim 13 wherein said generating circuit includes a comparator providing a high and low voltage control signal.

16. An elevator controller according to claim 13 wherein said generating circuit includes a D/A converter providing an analog signal to linearly adjust said variable circuits.

17. An elevator controller according to claim 13 wherein said controllable circuits include variable attenuator associated with a receiving amplifier and a transmitting output circuit of said transmitter-receiver to attenuate the radio signal and thereby avoid saturating the receiving circuits.

* * * * *